United States Patent [19]

Collura et al.

[11] Patent Number: 4,464,155

[45] Date of Patent: Aug. 7, 1984

[54] APPARATUS AND METHOD FOR FORMING AND DEBOWING CARTONS

[75] Inventors: Peter C. Collura, Los Altos; Boyd D. Goda, Santa Clara; Harvey N. Palagi, San Carlos, all of Calif.

[73] Assignee: Kliklok Corporation, Greenwich, Conn.

[21] Appl. No.: 329,878

[22] Filed: Dec. 11, 1981

[51] Int. Cl.[3] ..... B31B 1/48

[52] U.S. Cl. ..... 493/137; 493/174; 493/310

[58] Field of Search ..... 493/171, 174, 143, 142, 493/137, 167, 310

[56] References Cited

U.S. PATENT DOCUMENTS

| | | | |
|---|---|---|---|
| 2,832,270 | 4/1958 | Pierce, Jr. et al. | 493/167 X |
| 2,863,370 | 12/1958 | Dorfman | 493/174 X |
| 2,864,287 | 12/1958 | Johnson et al. | 493/137 |
| 2,997,930 | 8/1961 | Pierce, Jr. | 493/167 X |
| 3,400,640 | 9/1968 | Randles | 493/174 X |
| 4,283,190 | 8/1981 | Williams et al. | 493/131 |

*Primary Examiner*—James F. Coan

*Attorney, Agent, or Firm*—King and Liles

[57] ABSTRACT

An apparatus and method for forming flat cut carton blanks into erected cartons with debowed carton side panels is disclosed. The apparatus includes a forming head receiving and directing a carton blank through forming guides, side walls engaging and supporting the carton side panels that bend into upright position relative to the carton bottom panel during descending movement through the forming guides. Presser fingers pivotally secured to the forming guides project inwardly into the forming head path. The presser fingers bend the side panels into cutout openings provided in the side walls to overbreak the side panels at fold lines between the carton side and bottom panels. An inclined surface with a sharp creasing edge abutting the fold lines enables the presser fingers to initially crease the fold lines and thereafter bend the carton side panels inwardly onto the inclined surface for controlled overbreaking movement. The height of the cutout opening allows each carton side panel to clear the upper periphery of the openings to prevent buckling. After debowing the side panels, the presser fingers engage the upper edges of the carton side panels to strip the erected cartons from the forming head during the ascending return stroke. Notches provided in the side walls serve to prevent interference contact of the presser fingers with the forming head.

16 Claims, 8 Drawing Figures

APPARATUS AND METHOD FOR FORMING AND DEBOWING CARTONS

BACKGROUND OF THE INVENTION

This invention relates generally to an apparatus and method for forming flat cut carton blanks into erected cartons, and more particularly, to an apparatus and method for debowing the erected carton side panels during the forming operation.

Apparatus are known for forming flat cut carton blanks into erected cartons. The carton blanks are generally of rectangular configuration having a bottom panel and opposing side and end panels connected therewith along fold lines. Locking tabs are provided on the end panels for engagement with slits provided on the side panels during the forming operation. Locking retention between the tabs and slits serves to maintain the cartons in erected condition for subsequent filling and/or lidding operations.

Known carton forming apparatus typically include a feeder mechanism for depositing a carton blank onto a die. A forming head, or plunger, of rectangular configuration corresponding to the erected carton size, then engages the carton bottom panel to force the blank in a descending forming stroke through the die. The die includes forming guides engaging the carton sides and end panels during passage of the forming head through the die. In this manner, the carton side and end panels gradually bend along their fold lines into upright position relative to the carton bottom panel, in engagement with corresponding end and side walls of the forming head. The die also includes stripper fingers to force the locking tabs into the slits.

During further operation, the forming head descends completely through the die, where spring loaded fingers, such as the type disclosed in U.S. Pat. No. 2,997,930 to Pierce (owned by the assignee of the present invention) are positioned to project slightly into the path of the forming head. As the forming head descends below the fingers into an end-of-stroke position, the biased fingers engage the upper edges of the carton side panels. Thereafter, the forming head ascends to receive the next in-line carton blank. However, since the carton is now positively arrested by the fingers, the erected carton is stripped from the forming head and dropped onto a suitable conveyor positioned below.

Due to the natural flexural strength or bending memory of the carton side panels, the erected panels sometimes tend to be outwardly bowed after passing through the die, as is shown in FIG. 2*a* of the drawing. Consequently, difficulties are encountered in applying and sealing lids on the erected cartons, resulting in increased production time. Furthermore, in view of the outwardly bowed condition of the side panels, the cartons exhibit less than ideal product retention properties. Also, a carton with bowed sides is unsightly and hinders the sales appeal of product. In the past, where the problem is acute, the only solution is to perform a separate debowing operation on the carton. This, of course, adds considerable expense and slows the carton forming operation.

SUMMARY OF THE INVENTION

It is accordingly an object of the present invention to provide an improved method and apparatus for debowing the carton side panels during the carton forming process.

Another object is to provide an apparatus for debowing the side panels using a specially designed forming head and cooperating pressing means to effect overbreaking of the carton side panels.

Another object is to provide a method and apparatus for engaging and creasing the fold lines between the bottom and side panels to effect overbreaking in a unique manner.

Still another object of the present invention is to provide an improved method and apparatus for debowing a carton resulting in increased production of a more desirable, accurately formed carton.

Additional objects, advantages and novel features of the invention will be set forth in detail in part in the description which follows and in part will become apparent to those skilled in the art upon examination of the drawing, or may be learned by practice of the invention. The objects and advantages of the invention may be realized and obtained by means of the instrumentalities and combinations particularly pointed out in the appended claims.

An apparatus capable of forming flat cut carton blanks into erect cartons with debowed carton side panels includes a forming head reciprocated through a die. During a descending forming stroke, the forming head receives a carton blank and directs the same through the die where forming guides bend the carton side panels and end panels into upright position relative to the carton bottom panel. The forming head includes relieved, opposing side walls; i.e. walls formed with cutout openings providing space for erected side panels to bend inwardly from the fold lines during engagement with pressing means positioned below the die. The pressing means projects into the path of the forming head to engage and crease the fold line and direct the erected side panels into the cutout openings, thereby overbreaking and debowing the side panels.

The side walls include an inclined surface extending along the lower periphery of the cutout openings. The surface includes a sharp, lower edge that engages and creases the fold line during contact with the pressing means. The surface extends inwardly from the lower edge at a predetermined angle and controls the overbreaking angle of the side panels during bending onto the surface during the overbreaking operation.

The height of each cutout opening is sufficient to enable the upper edge of each carton side panel to clear the upper periphery of the opening so that the panels can bend inwardly without buckling during engagement with the pressing means.

The pressing means preferably includes a plurality of presser fingers pivotally secured to the forming guides below forming guide edges. Each presser finger is biased inwardly into the forming head path with spring means for engagement with the carton side panels during descending movement of the forming head. The spring means produces a force sufficient to urge the presser fingers against the fold line of the carton side panels to bend the panels into overbreaking engagement with the inclined surfaces of the forming head side walls.

The presser fingers are preferably positioned along the forming stroke so as to engage and trap an upper edge of the carton side panels after pressing engagement occurs. The erected carton is then stripped from the forming head during the ascending return stroke.

Notches are provided in the forming head side walls to prevent wearing contact of the presser fingers during the ascending return stroke.

Still other objects of the present invention will become readily apparent to those skilled in this art from the following description wherein there is shown and described a preferred embodiment of this invention, simply by way of illustration of one of the best modes contemplated for carrying out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE INVENTION

Figure 1:
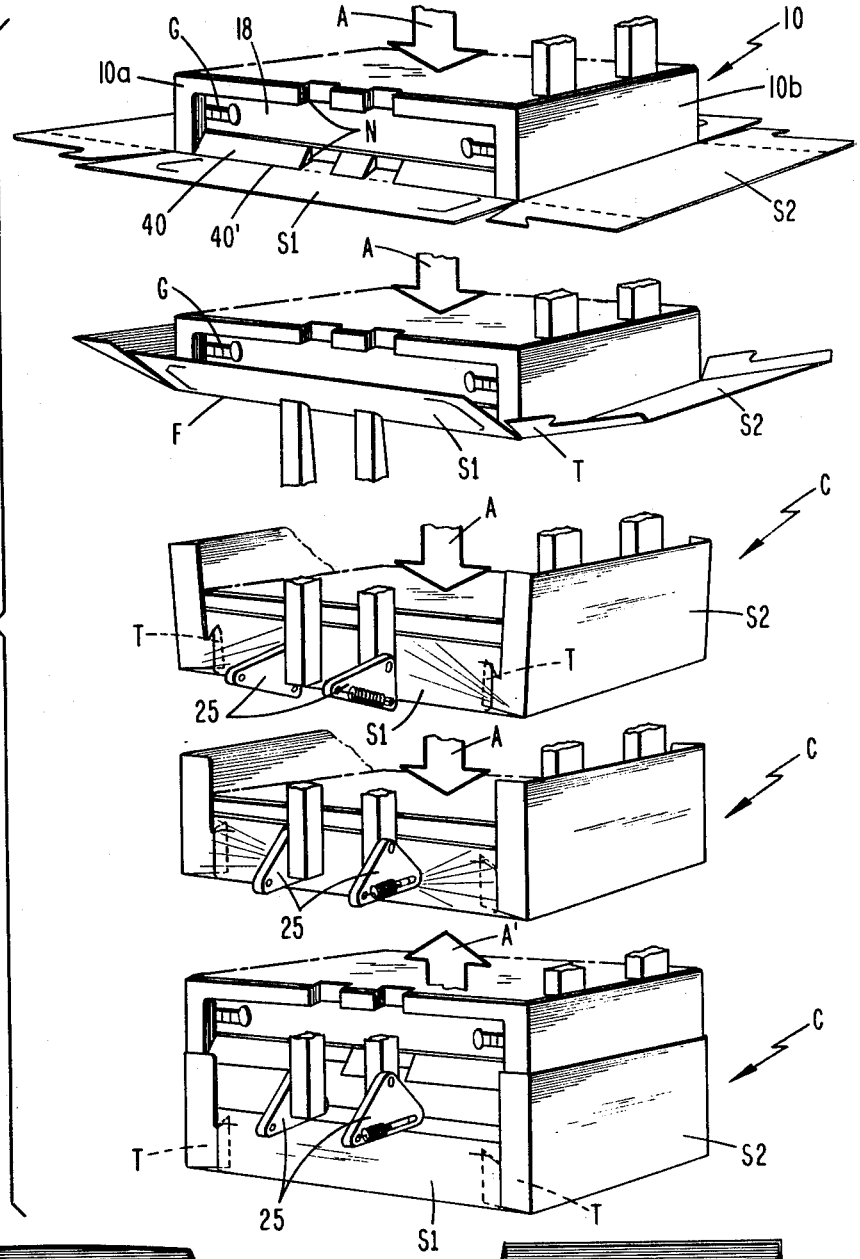
FIG. 1 is a series of perspective views of a combined forming and debowing apparatus in accordance with the invention, showing progressive locations of the forming head and the carton during the descending forming stroke in relation to the presser fingers and stripping of the carton on the ascending stroke.

Referring to Composite FIG. 1, a forming head, generally designated by reference numeral 10, is used to direct or plunge a flat cut carton blank through a suitable die to form erected cartons C. The cartons are usually plastic coated paperboard, for packaging frozen foods or the like, and include opposing pairs of side panels S1 and relatively shorter end panels S2 attached to a bottom panel B along fold lines F therebetween, forming a rectangular body (see FIG. 2 also).

Figure 2A:
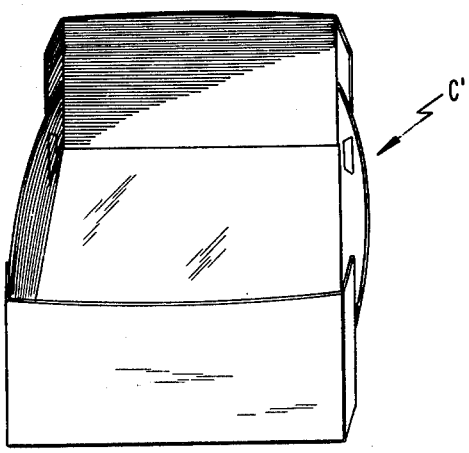
Fig. 2a PRIOR ART
FIG. 2*a* is a perspective view of an erected carton formed with prior art apparatus and methods, resulting in outwardly bowed carton side panels.
Figure 2:
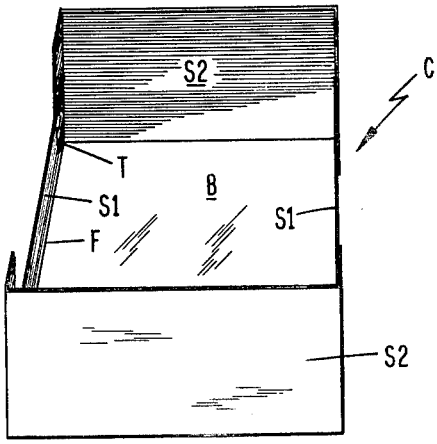
FIG. 2 is a perspective view of an erected carton formed with the apparatus and method of the present invention resulting in debowed side panels.

In accordance with various features of the invention set forth below, the carton side panels S1 are debowed after forming to stand upright in relation to the carton bottom panel B, as shown in FIG. 2 (cf. carton C' of prior art in FIG. 2*a*). Thusly debowed, a lid (not shown) can be positively seated in flush engagement on the side panels and end panels to cover the carton mouth and fully seal the contents.

Forming head 10 includes a pair of side walls 10*a* and end walls 10*b* (one each shown in FIG. 1) corresponding respectively in length to the carton side panels S1 and end panels S2. The walls 10*a* and 10*b* of the head define a generally rectangular block with an under side corresponding to the carton bottom panel B.

Figure 3:
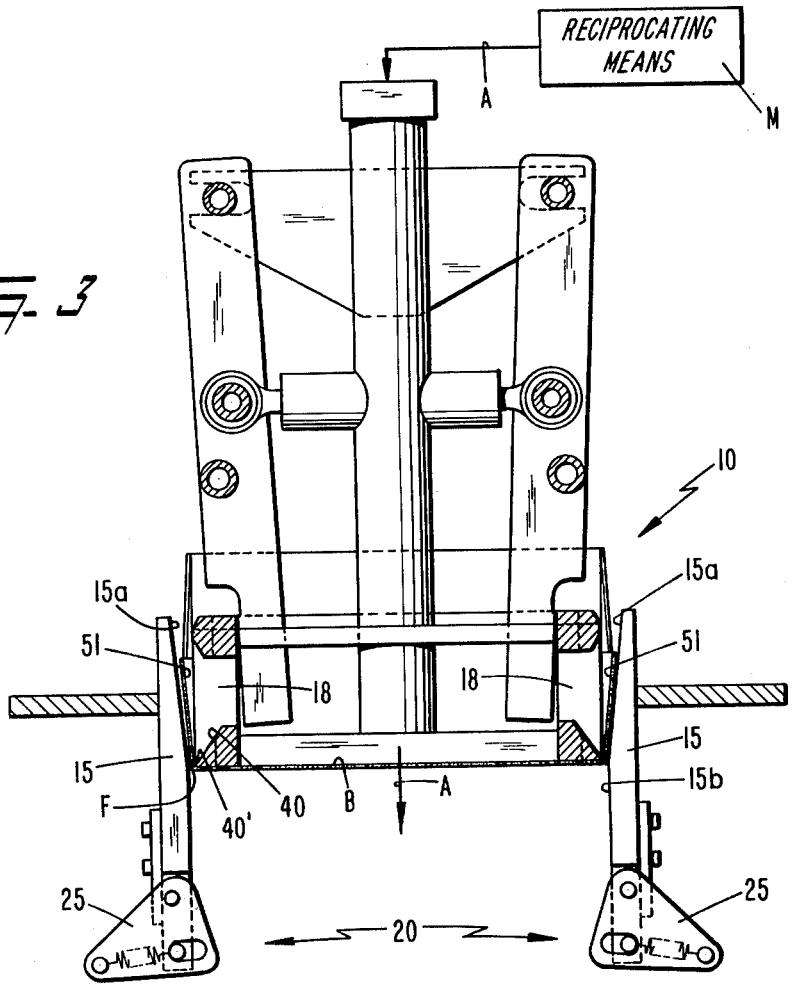
FIG. 3 is a cross-sectional view of the forming head of the present invention in an intermediate position descending through the forming guides and with the carton partially erected.

A reciprocating means M (as shown in FIG. 3) drives forming head 10 in a descending stroke, as indicated by arrows A (see FIGS. 1 & 3–6), to form the erected Carton C. An ascending return stroke (see arrow A' in FIGS. 1 & 7) also achieved with the moving means M, thereafter returns forming head 10 to an upper, carton blank receiving position for erecting the next in-line blank of a continuing carton forming operation.

In the uppermost position, a carton blank is positioned in the path of forming head 10 with a suitable feeder mechanism (not shown) so that carton bottom panel B engages the underside of the head. Next, the head begins its descending forming stroke with the captured carton blank to direct the same through a die.

Figure 4:
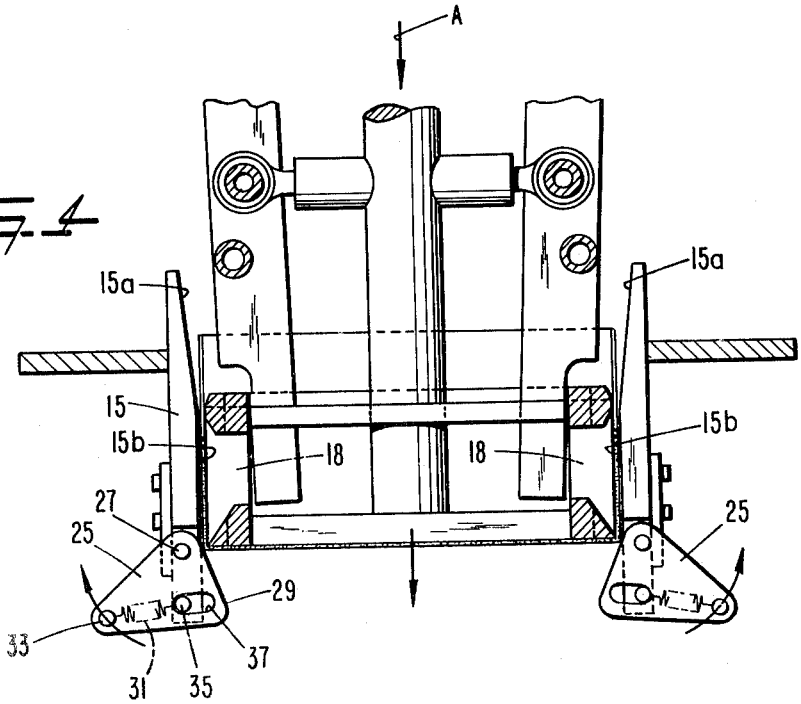
FIG. 4 is a cross-sectional view similar to FIG. 3 but with parts broken away and showing the carton side panels and forming head descending into initial engagement with the presser fingers.

As best shown in the next two sequential perspectives of FIG. 1 and in FIGS. 3 and 4, the die includes a plurality of side forming guides 15 positioned immediately adjacent the forming path. The guides 15 are substantially parallel to the forming head side walls 10*a*. As the forming head 10 descends between guides 15, the flat carton side panels S1 engage these guides and are gradually forced upwardly into upright erected condition relative to bottom panel B, along the fold lines F. Suitable additional forming guides (not shown) may be used for the sides, as well as the ends, to bend carton panels S1, S2 into erected position. Stripping fingers G strip or pull the locking tabs T into the slits provided on side panels S1 (see FIGS. 1 and 2).

Inwardly directed guide edges 15*a* of guides 15 taper downwardly along the forming path so as to provide gradual bending engagement with fold lines F. This feature assures smooth and gradual bending movement of carton side panels S1 with no damage to the side panels and to assure reliable, high speed production. The guide edges 15*b* (formed below edges 15*a*) of guides 15 are parallel to the forming head side walls 10*a* so as to bend the side panels S1 into substantially parallel engagement with the side walls. This engagement positions the carton side panels S1 relative to the carton bottom panel B (see FIG. 4). However, at this point in the forming process, the actual appearance of the erected carton sides would resemble the carton sides shown by carton C' in FIG. 2*a*, if the carton is removed without further operation.

A rectangular cutout opening 18 is provided in each forming head side wall 10*a*. Cutout openings 18 advantageously provide space to allow the erected side panels S1 to bend inwardly from fold lines F, into the openings, when the side panels are engaged by a pressing means 20. This provides overbreaking action of the side panels S1 at the fold lines F so that when released the panels return to be substantially perpendicular (see FIG. 2).

The pressing means 20 preferably includes spring-loaded presser fingers 25. Each presser finger 25 is substantially triangular and pivoted to forming guide 15 on pin 27, and acts as an extension of guide edges 15*b* (see FIG. 4). An inwardly directed pressing edge 29 projects slightly into the forming head path under the tension force of a spring 31. Spring 31 interconnects each presser finger 25, at outer end 33, to a guide pin 35 attached to the forming guide 15. The guide pin 35 engages a guide slot 37 formed in finger 25 adjacent pressing edge 29 to limit pivoted movement of each finger into and out of the forming head path, as discussed below.

Each cutout opening 18 extends across a major portion of side wall 10*a*, and includes an inclined overbreaking surface 40 defining the lower peripheral edge of the opening. As shown in FIG. 1, the surface 40 extends inwardly into the opening 18 from a relatively sharp lower creasing edge 40'. Creasing edge 40' is in constant abutting engagement with fold line F of the carton and in the plane of side wall 10*a*. The edges 40' serve to permanently trap the carton side panel S1 at the fold line F in the forming stroke. The surface 40 advantageously serves to control maximum overbreaking movement of the side panels S1 in the manner described below. The height of each opening 18, as measured from edge 40', is sufficient to allow each entire side panel S1 to bend inwardly from the fold line F without interference, thereby avoiding undesirable buckling effects.

In operation, each pressing edge 29 is biased inwardly into the forming head path with the spring 31. The edges 29 extend from guide edges 15*b* and incline downwardly at a shallow angle in relation to the vertical forming guides 15. This inclination enables gentle and easy deflection of the pressing edges away from the forming head path when initial contact is made with the carton descending through forming guides 15 (see FIG. 4).

As the carton C and forming head 10 descend between guide edges 15*b*, the presser fingers 25 engage the outer surface of the carton side panels in low friction sliding movement. This initial contact, as aforesaid, operates to pivotally deflect the presser fingers 25 away from the path, for smooth, uninterrupted descending movement (see arrows in FIGS. 4 and 5) of the forming head.

Figure 5:
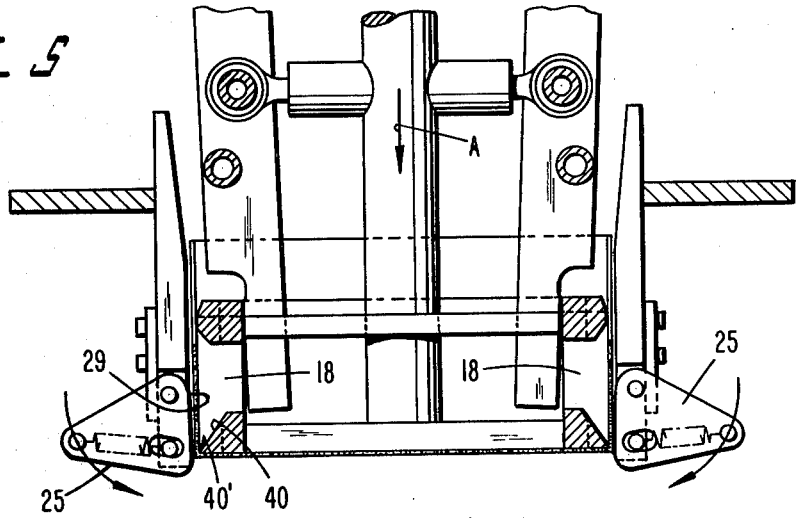
FIG. 5 is a cross-sectional view similar to FIG. 4 showing deflection of the presser fingers caused by initial engagement with the carton side panels (cf. third sequential view of FIG. 1)
Figure 6:
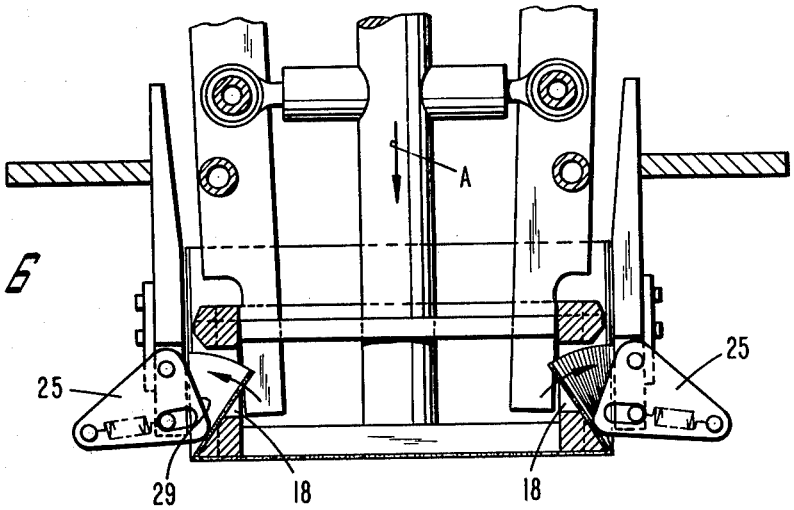
FIG. 6 is a view similar to FIG. 5 illustrating overbreaking and debowing engagement of the carton side panels by the presser fingers (cf. fourth sequential view of FIG. 1)

As the creasing edge 40' initially descends along the pressing edge 29, the force of spring 31, urges the pressing edge firmly into the forming path and against the panels S1, as shown in FIG. 5. Initially, this return movement allows pressing edge 29 to advantageously engage and crease carton side panels S1 at fold lines F, along the sharp creasing edge 40' (note FIGS. 5 & 6).

As carton C continues to descend, pressing edge 29 continues to bend side panels S1 inwardly into openings 18, so that the side panels are forced to bend into abutting engagement with inclined surface 40. This contact gradually flexes the side panels 51 and the upper free edges thereof into the openings 18 so that the panels do not buckle. Progressive descending movement of carton C on the forming head allows pressing edge 29 to gradually press against the full height of the side panels; and, in this manner, overbreaking of the side panels occurs in a controlled fashion. The overbreaking occurs at and never exceeds the angle of inclination of surface 40 (i.e. approximately 45°) relative to the carton bottom panel. In this manner, controlled overbreaking of the side panels assures that the panels spring to the desirable upright, debowed condition relative to the carton bottom panel, as shown in FIG. 2.

Figure 7:
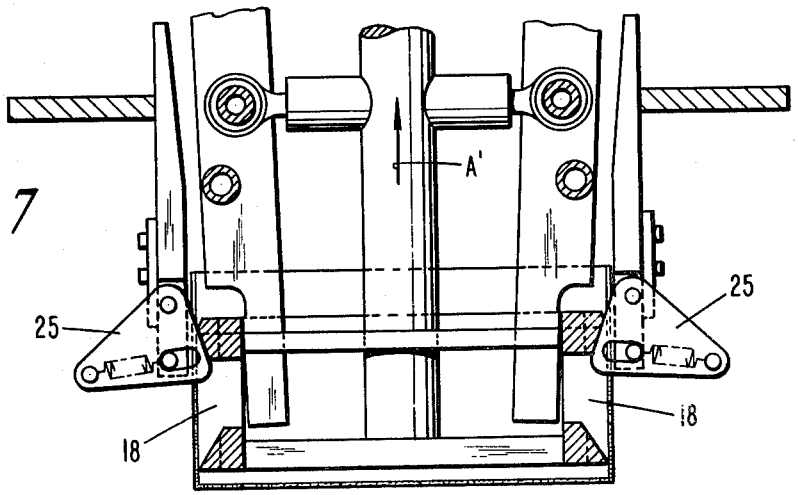
FIG. 7 is a view similar to FIG. 6 but with the forming head ascending and the presser fingers engaging the carton side panels to strip the erected carton from the forming head (cf. fifth sequential view of FIG. 1).

The feature of providing a cutout opening 18 with an inclined overbreaking surface 40 formed in each side wall 10*a*, in combination with presser fingers 25, serves to assure that the carton side panels S1 always overbreak into debowed condition in a gentle and uniform manner during the forming stroke. Further, as shown in FIG. 7, presser fingers 25 can be so positioned in the forming stroke to engage and trap the upper free edges of carton side panels S1 immediately after debowing occurs. This engagement coincides with the completion of the descending forming stroke. Thereafter, ascending return movement of forming head 10 allows fingers 25 to strip the erected carton C from the forming head and onto a suitable conveyor mechanism (not shown).

A plurality of notches N (see FIG. 1) are provided in side walls 10*a* in alignment with presser fingers 25. Notches N serve to allow ascending movement of forming head 10, after stripping occurs, without engaging the presser fingers 25. This feature serves to prevent undesirable wearing contact of the fingers with side walls 10*a*. In the event forming head 10 performs a descending forming stroke without an accompanying carton, the aforesaid wearing contact is also prevented by allowing the presser finger 25 to pass through the notches.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment is chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. In an apparatus for forming flat cut carton blanks into erect cartons having side panels attached to a bottom panel along fold lines therebetween, said apparatus including a forming head having opposed side walls, and reciprocating moving means enabling the forming head to receive and direct a carton blank through a die into erected condition with the side panels of the carton engaging the side walls, the improvement comprising:

(a) cutout openings formed in the side walls of the forming head allowing the erected side panels to bend inwardly from the fold lines; and (b) pressing means operatively positioned in the path of the forming head to engage and crease the fold line and direct the erected side panels inwardly into the cutout openings to a sufficient extent for overbreaking and debowing the carton side panels.

2. In an apparatus according to claim 1, wherein said side walls further include an inclined surface defining the lower periphery of the cutout openings, said surface having a substantially sharp creasing edge engageable with the fold lines to thereby crease the fold line during engagement with the pressing means.

3. In an apparatus according to claim 2, wherein said inclined surface is upwardly tapered at a predetermined angle, thereby allowing the side panels to bend inwardly onto the surface into inclined position corresponding to the predetermined angle during overbreaking operation.

4. In an apparatus according to claim 3, wherein said pressing means includes a plurality of presser fingers.

5. In an apparatus according to claim 4, wherein each presser finger is pivotally secured to a forming guide below forming guide edges.

6. In an apparatus according to claim 5, wherein each presser finger further includes a pressing edge positioned in the path of the forming head with spring means, said pressing edge being engageable with the side panels.

7. In an apparatus of claim 6, wherein said spring means includes a tension spring interconnecting the presser finger to the forming guide.

8. In an apparatus according to claim 7, said spring means being operable to produce a predetermined force sufficient to urge the pressing edges against the fold lines of the carton side panels and bend the panels into engagement with the inclined surfaces thereby overbreaking and debowing the side panels.

9. In an apparatus according to claim 8, said cutout openings having a height enabling an upper edge of each side panel to clear an upper periphery of the cutout opening and bend inwardly during engagement with the presser fingers without buckling.

10. In an apparatus according to claim 9, wherein said presser fingers are positioned to engage an upper edge of the carton side walls after debowing, thereby stripping the erected and debowed carton from the forming head during an ascending return stroke of the forming head.

11. In an apparatus according to claim 10, wherein said side walls further include a plurality of notches to enable the presser fingers to pass through the notches and thereby avoid contact with the side walls during an ascending return stroke of the forming head.

12. In an apparatus according to claim 1, wherein said cutout openings in the side walls of the forming head are substantially positioned along the center thereof to insure inward folding and proper overbreaking and debowing of the entire carton side panels.

13. A method for debowing side panels of an erected carton formed from flat cut carton blanks having a bottom panel and fold lines between the bottom panel and side panels, said carton blanks being formed on an apparatus including a forming head for receiving and directing the carton blank with reciprocating moving means through a die having forming guides, comprising the steps of:

(a) erecting the carton blank to a partially erected position by moving the forming head in a descending forming stroke in response to reciprocating means, (b) passing the partially erected carton through the side forming guides so as to allow the carton side panels to engage the forming guides and bend upwardly into upright position relative to the bottom panel, said side panels thereby engaging side walls of the forming head;

(c) pressing the erected carton side panels inwardly from the fold lines into cutout openings formed in the forming head said walls with pressing means positioned in the path of the forming head, said pressing being sufficient to overbreak the side panels; and (d) disengaging the pressing means from the carton side panels during continued descending movement of the forming head below the pressing means, thereby enabling the side panels to assume a debowed position relative to the carton bottom panel.

14. The method according to claim 13, including the further step of stripping the erected carton from the forming head with the pressing means positioned to engage the upper edges of the carton side panels prior to the ascending return stroke of the forming head.

15. The method according to claim 13, wherein the pressing step further requires pressing the erected carton side panels onto inclined surface means extending into the cutout openings at a predetermined angle, thereby controlling the degree of overbreaking of the side panels.

16. The method according to claim 13, including the further step of creasing the fold lines with the pressing means prior to pressing the erected side panels inwardly from the fold lines.

* * * * *